US009409180B2

(12) United States Patent
Ali

(10) Patent No.: US 9,409,180 B2
(45) Date of Patent: Aug. 9, 2016

(54) COMPOSTABLE WASTE PROCESSING APPARATUS

(71) Applicant: UMM AL-QURA UNIVERSITY, Makkah (SA)

(72) Inventor: Dhuha Hamed Nawab Ali, Makkah (SA)

(73) Assignee: UMM AL-QURA UNIVERSITY, Makkah (SA)

( * ) Notice: Subject to any disclaimer, the term of this patent is extended or adjusted under 35 U.S.C. 154(b) by 108 days.

(21) Appl. No.: 14/181,296

(22) Filed: Feb. 14, 2014

(65) Prior Publication Data

US 2015/0231637 A1 Aug. 20, 2015

(51) Int. Cl.

| | |
|---|---|
| ***B02C 18/24*** | (2006.01) |
| ***B02C 18/00*** | (2006.01) |
| ***B02C 18/22*** | (2006.01) |
| ***B02C 4/42*** | (2006.01) |

(52) U.S. Cl.

CPC ..... *B02C 18/0084* (2013.01); *B02C 4/42* (2013.01); *B02C 18/2216* (2013.01); *B02C 18/24* (2013.01)

(58) Field of Classification Search

CPC .... B02C 18/0007; B02C 23/08; B02C 25/00; B02C 18/0084; B02C 18/24; B02C 18/2216; B02C 4/42

USPC ..... 241/17, 65

See application file for complete search history.

(56) References Cited

U.S. PATENT DOCUMENTS

| | | | | |
|---|---|---|---|---|
| 2,584,262 A | | 2/1952 | De Lamater, Sr. | |
| 3,850,364 A | | 11/1974 | Robbins | |
| 3,934,999 A | | 1/1976 | Meier | |
| 4,645,594 A | * | 2/1987 | Lingo, Sr. | C02F 1/28 210/170.01 |
| 5,242,122 A | * | 9/1993 | Bogen | B02C 17/16 241/171 |
| 5,842,652 A | * | 12/1998 | Warsing | B65F 1/0033 241/101.741 |
| 8,025,246 B1 | * | 9/2011 | Brown | A47G 29/12 241/100 |
| 2005/0036925 A1 | * | 2/2005 | Butler | A61L 11/00 422/309 |
| 2011/0101137 A1 | | 5/2011 | Langston | |
| 2013/0037639 A1 | * | 2/2013 | Chen | B02C 23/18 241/47 |
| 2013/0075503 A1 | * | 3/2013 | Chen | B02C 18/10 241/17 |

FOREIGN PATENT DOCUMENTS

ES 2214944 A1 * 9/2004

OTHER PUBLICATIONS

English Translation of ES2214944A1 is Attached as "ES2214944_English_Translation.Pdf".*

*Composting Starter Kit,* Meijer website.

* cited by examiner

*Primary Examiner* — Shelley Self
*Assistant Examiner* — Peter Iannuzzi
(74) *Attorney, Agent, or Firm* — Richard C. Litman

(57) ABSTRACT

The compostable waste processing apparatus includes a pulverizing device and a shredding device in separate compartments within a housing. The pulverizing device and the shredding device may be driven by at least one electronic motor. The electronic motor may be powered by one or more batteries that are charged by a photovoltaic panel of the housing. The compostable waste processing apparatus has a simple and efficient structure to facilitate use by a wide range of end-users, including households.

8 Claims, 5 Drawing Sheets

COMPOSTABLE WASTE PROCESSING APPARATUS

BACKGROUND OF THE INVENTION

1. Field of the Invention

The present invention relates generally to waste processing, and more specifically, to an apparatus for processing waste for use as compost.

2. Description of the Related Art

Composting has many benefits to the environment. Compost is a key ingredient in organic farming.

Modern, methodical composting is a multi-step, closely monitored process with measured inputs of water, air and carbon- and nitrogen-rich materials. The decomposition process is aided by shredding plant matter, adding water and ensuring proper aeration by regularly turning the mixture. Worms and fungi may further break up the material. Aerobic bacteria manage the chemical process by converting the inputs into heat, carbon dioxide and ammonium. Ammonium is further converted by bacteria into plant-nourishing nitrites and nitrates through the process of nitrification.

Compost can be rich in nutrients. It is used in gardens, landscaping, horticulture, and agriculture. The compost itself is beneficial for land in many ways, including as a soil conditioner, a fertilizer, addition of vital humus or humic acids, and as a natural pesticide for soil.

In ecosystems, compost is useful for erosion control, land and stream reclamation, wetland construction, and as landfill cover. Compost can also be used to generate biogas through anaerobic digestion.

Given the significant advantages of composting, numerous environmental benefits may be achieved if more members of society could take part in processing compostable waste generated in their households and composting such waste. Conventional methods of processing compostable waste are often not ideal for residential use as they generally involve large and/or complex machinery.

Thus, a compostable waste processing apparatus solving the aforementioned problems is desired.

SUMMARY OF THE INVENTION

The compostable waste processing apparatus includes a pulverizing device and a shredding device in separate compartments within a housing. The pulverizing device and the shredding device may be driven by at least one electronic motor in the compostable waste processing apparatus. The electronic motor may be powered by one or more batteries that are charged by a photovoltaic panel of the housing. The compostable waste processing apparatus has a simple and efficient structure to facilitate use by a wide range of end-users, including households.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The compostable waste processing apparatus is adapted for processing waste for composting. The compostable waste processing apparatus may include a pulverizing device and a shredding device in separate compartments within a first housing. The pulverizing device and the shredding device may be driven by at least one electronic motor. The electronic motor and one or more batteries for powering the electronic motor may be provided in a second housing of the compostable waste processing apparatus. The compostable waste processing apparatus may further include a photovoltaic panel for charging the batteries.

The compostable waste processing apparatus may be compact, lightweight, and easy to use. As such, the compostable waste processing apparatus may be operated in any suitable setting, including recycling centers and processing facilities, as well as residential and business settings. The compostable waste processing apparatus may thereby increase societal involvement in the recycling and composting process.

Figure 1:
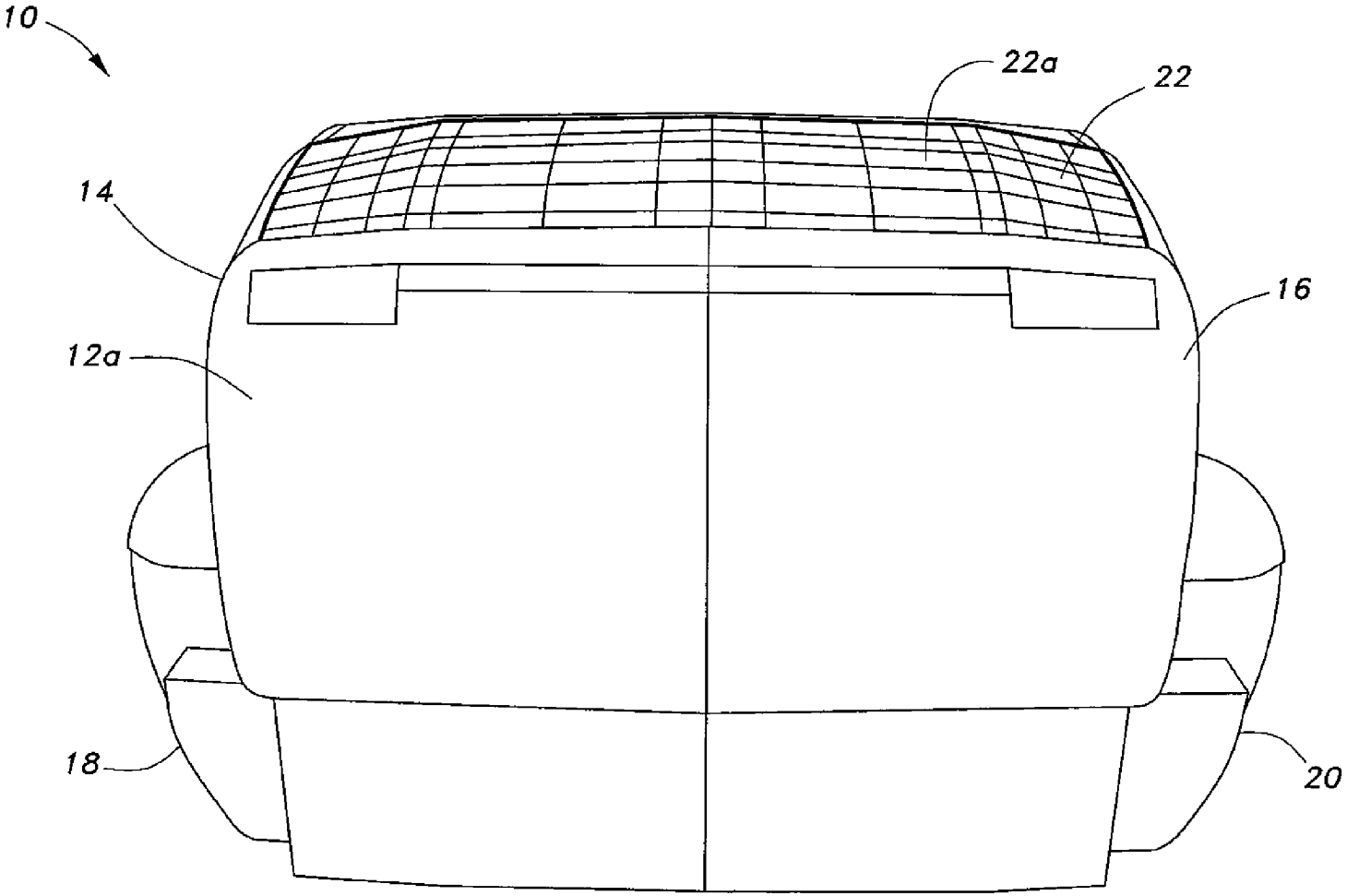
FIG. 1 is a perspective view of a compostable waste processing apparatus according to the present invention.
Figure 2:
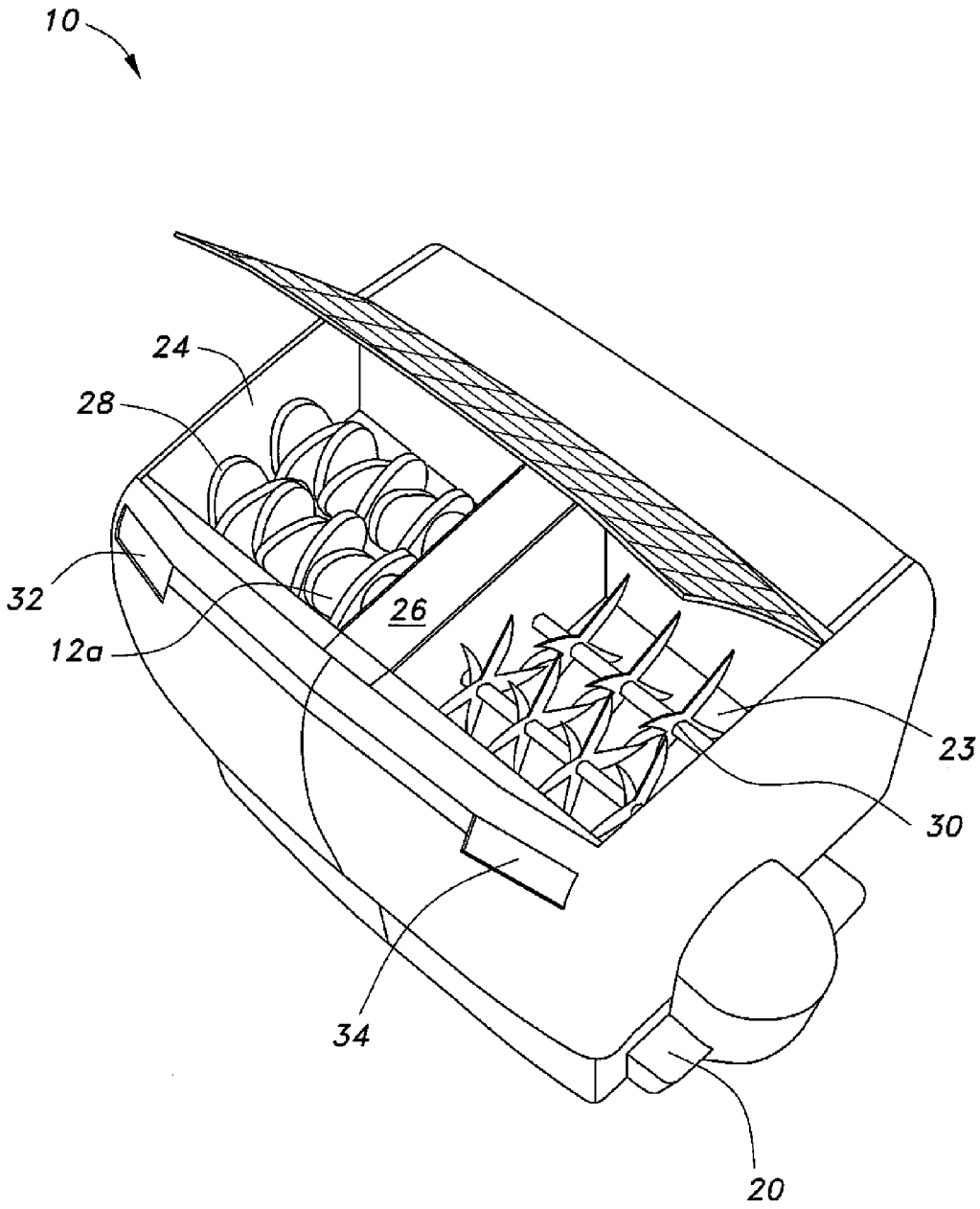
FIG. 2 is a perspective view of the compostable waste processing apparatus of FIG. 1 as seen from the top with the first door opened.

FIG. 1 is a front view of an exterior of the compostable waste processing apparatus 10. The compostable waste processing apparatus 10 may include a first housing 12 a having a first compartment 14, a second compartment 16, a first collection drawer 18 attached to the first compartment 14, a second collection drawer 20 attached to the second compartment 16, and a first door or lid 22 covering a top portion of the first housing 12*a*. The first collection drawer 18 and the second collection drawer 20 may be laterally opposed and slidably attached to the first housing 12*a*. The first door 22 may include a photovoltaic panel 22*a*. The first door 22 may be movably attached to the first housing 12*a*, e.g., hingedly or slidably attached, to facilitate access to an interior of the first housing 12*a*, as shown in FIG. 2. The first door 12 may be opened to allow disposal of compostable wastes into the first housing 12*a* for processing. Compostable wastes may include organic and inorganic waste products, such as fruit, vegetable, and other food products, as well as paper or plastic wrapping and packaging articles.

As can be seen in FIG. 2, the first housing 12*a* may include a peripheral wall 24 and the first compartment 14 and the second compartment 16 may be separated by a divider wall 26. The first housing 12*a* may include a floor or bottom wall 23 extending between the peripheral wall 24. The first housing 12*a*, including the peripheral wall 24 and the divider wall 26, may be formed from a suitable insulating material that is non-stick, resistant to rust and that does not absorb moisture. Preferably, the peripheral wall 24, the divider wall 26 and the bottom wall include fiberglass insulation.

The first compartment 14 and the second compartment 16 may be laterally aligned. The first compartment 14 may include a pulverizing device 28. The second compartment 16 may include a shredding device 30. The pulverizing device 28 and the shredding device 30 may be independently operable by first and second buttons, 32 and 34 respectively, which are provided on the exterior of the compostable waste processing apparatus 10. Compostable waste suitable for grinding or pulverizing, particularly food waste, may be disposed in the first compartment 14 and pulverized or comminuted by the pulverizing device 28, then discharged into the first collection drawer (FIG. 1). Compostable waste suitable for cutting or shredding, particularly paper or plastic waste, may be disposed in the second compartment 16 and shredded or cut by the shredding device 30, then discharged into the second collection drawer 20. If desired, the processed waste gathered in the first collection drawer 18 may be disposed in the second compartment 16 for further processing. Similarly, the processed waste gathered in the second collection drawer 20 may be disposed in the first compartment 14 for further processing. After the waste has been sufficiently processed by the compostable waste processing apparatus 10, the waste may be composted.

Figure 3:
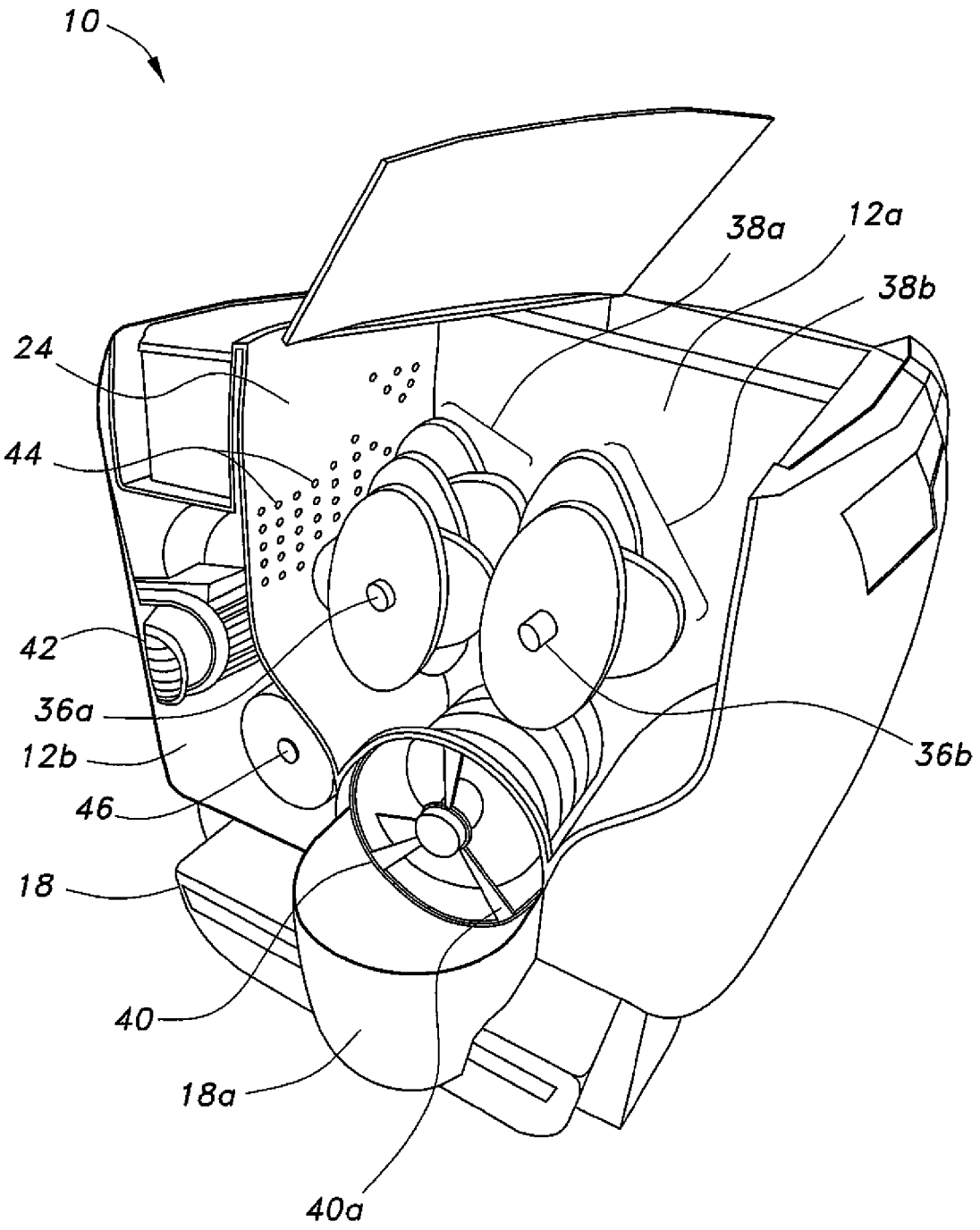
FIG. 3 is a perspective view of one side of the compostable waste processing apparatus of FIG. 1 with the housing broken away to show the first compartment.

The pulverizing device 28 may include any suitable grinder, granulator, hammer-mill, or other grinding device. Preferably, as shown in FIG. 3, the pulverizing device 28 includes two rotary shafts 36*a* and 36*b*, which are horizontally aligned and have a horizontal axis of rotation. Each of the rotary shafts 36*a* and 36*b*, may extend through a series pulverizing elements 38*a* and 38*b*, respectively. The pulverizing elements 38*a* and 38*b* may be configured to rotate around the horizontal shafts 36*a* and 36*b* in order to pulverize waste materials disposed in the first compartment. The pulverizing elements 38*a* and 38*b* may be, for example, a series of elliptical discs as is shown. A first collection channel 40, including an ejection mechanism 40*a*, may be provided below the pulverizing device 28 to capture and eject the pulverized waste into a receptacle 18*a* in the first collection drawer 18. The ejection mechanism 40*a* may include a blower, fan, screw, or other suitable device for ejecting the pulverized waste into the receptacle 18*a*.

As is further depicted in FIG. 3, the compostable waste processing apparatus 10 may also include a ventilation motor 42 to generate air flow and circulate air within the first housing 12*a*. The ventilation motor 42 may be provided in a second housing 12*b* of the compostable waste processing apparatus 10. The second housing 12*b* may be adjacent to the first housing 12*a*. Perforations 44 in at least a portion of the peripheral wall 24 may permit the generated air flow to enter the first housing 12*a*. The perforations 44 may be evenly or unevenly spaced along a side of the peripheral wall 24 that is closest to the ventilation motor 42. Although round perforations are shown, other shaped perforations may be formed. The perforations 44 may also facilitate evaporation of liquids from the processed waste. The second housing 12*b* may further include a motor 46 to drive the pulverizing device 28 and the shredding device 30. The motor 46 may also be configured to drive the ejection mechanism 40*a*.

Figure 4:
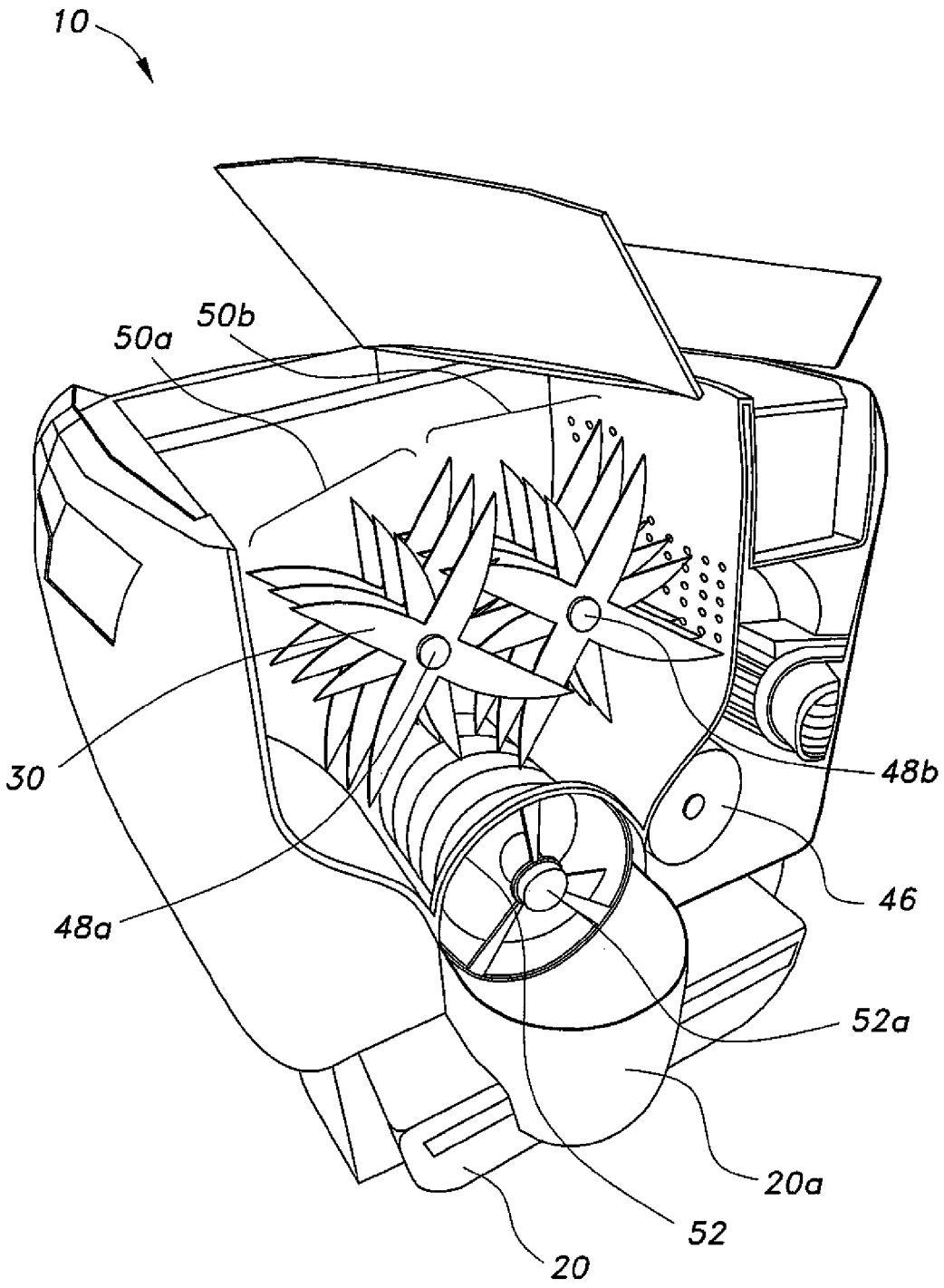
FIG. 4 is a perspective view of another side of the compostable waste processing apparatus of FIG. 1 with the housing broken away to show the first compartment.

The shredding device 30 may include shredding blades, cutters, or any other suitable shredder. Preferably, as shown in FIG. 4, the shredding device 30 includes two rotary shafts 48*a* and 48*b*, which are horizontally aligned and have a horizontal axis of rotation. Each of the rotary shafts 48*a* and 48*b* may extend through shredding elements 50*a* and 50*b*, respectively. The shredding elements 50*a* and 50*b* may be adapted to rotate around the respective horizontal shafts 48*a* and 48*b* in order to shred waste materials. The shredding elements 50*a* and 50*b* may be, for example, a series of blade cutters, as is shown, each cutter having multiple blades extending radially outward from the shaft. A second collection channel 52, including an ejection mechanism 52*a*, may be provided below the shredding device 30 to capture and eject the shredded waste into a receptacle 20*a* in the second collection drawer 20. The ejection mechanism 52*a* may include a blower, fan, screw or other suitable device for ejecting the shredded waste into the receptacle 20*a*.

Figure 5:
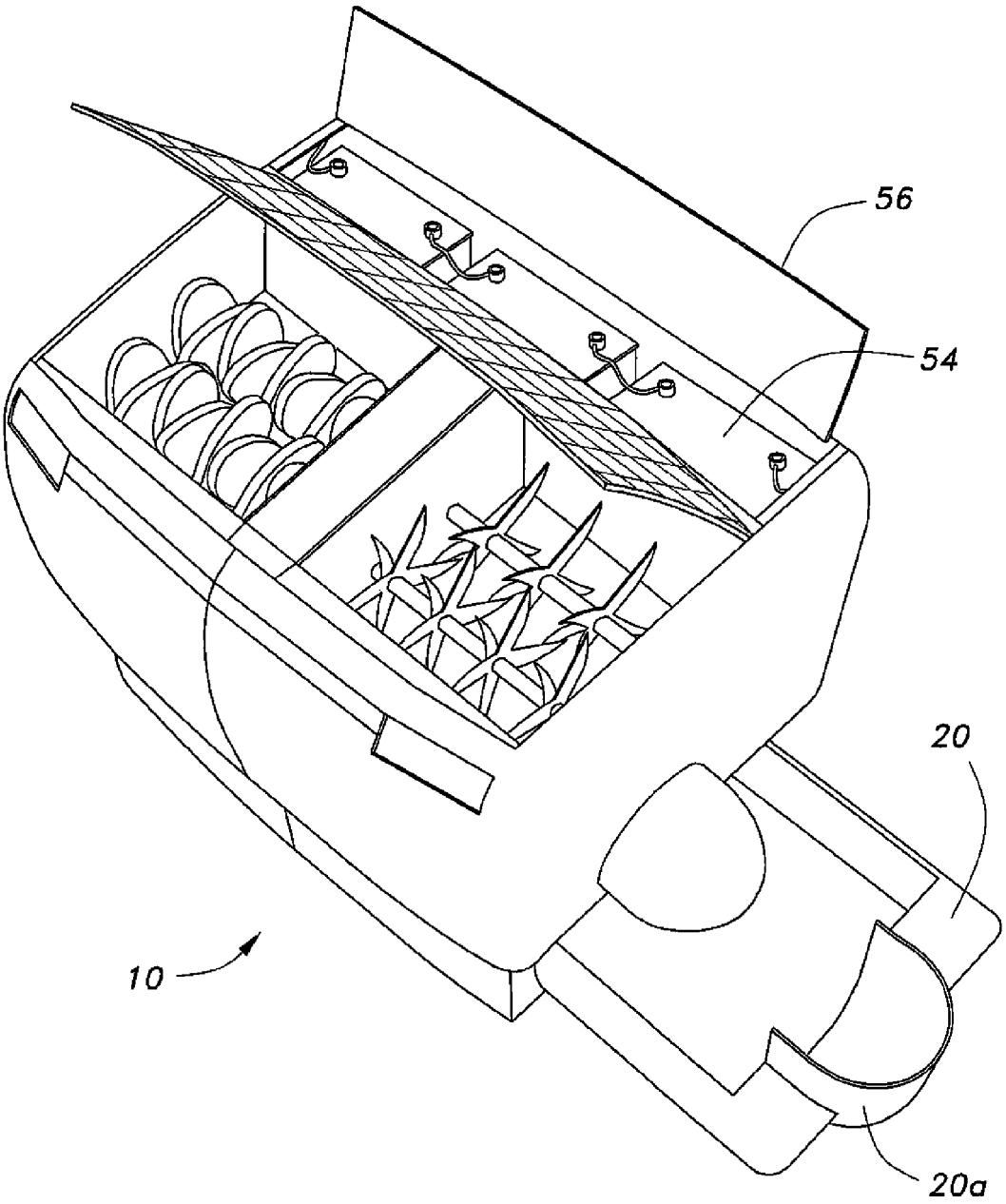
FIG. 5 is a perspective view of the compostable waste processing apparatus of FIG. 1, showing first and second doors open.

One or more batteries 54 may also be disposed within the second housing 12*b* to power the motor 46 that drives the pulverizing device 28 and the shredding device 30, as shown in FIG. 5. The photovoltaic panel 22*a* of the first door 22 may charge the batteries 54. A second door 56, adjacent the first door 22, may allow access to the batteries 54 in the second housing 12*b*. The second door 56 may be movably attached to the second housing 12*b*, e.g., hingedly or slidably attached. The first and second collection drawers 18 and 20 may slide out laterally as is shown in FIG. 5 for the second collection drawer 20.

The compostable waste processing apparatus 10 may be made from any suitable material known in the art. Preferably, an outer surface of the compostable waste processing apparatus 10 includes a reflective insulating material. For example, an outer surface of the compostable waste processing apparatus may include a polyethylene bubbled film sandwiched between two or more aluminium sheets.

The waste processed by the compostable waste processing apparatus may be composted in any suitable fashion. An exemplary composting method may include transferring the processed waste to a suitable container, e.g., a carton or box made from paper. The processed waste may be retained in the container for a suitable length of time, e.g., one week. The processed waste may then be drained to eliminate any liquid collected in the container. The remaining waste may be transferred into another suitable container that is perforated. The perforations of the container may allow entry of air into the container to prevent the build-up of undesirable odor. The waste in the container may be stirred periodically to accelerate the decomposition process. Water may be added to the container in an amount sufficient to keep the waste wet without flooding the container. Additional components, including soil, dry leaves, newspaper, plant derivatives, and/or manure, may be added to the container to further composting process.

It is to be understood that the present invention is not limited to the embodiments described above, but encompasses any and all embodiments within the scope of the following claims.

I claim:

1. A compostable waste processing apparatus, comprising:

a first housing, including:

a first compartment, the first compartment including a pulverizing device, and a second compartment laterally adjacent to the first compartment and separated from the first compartment by a divider wall, the second compartment including a shredding device; wherein said pulverizing device and said shredding device are distinct and different from each other;

a second housing adjacent to the first housing, the second housing including at least one motor adapted to drive the pulverizing device and the shredding device, and at least one battery for powering the motor;

a door movably affixed to a top portion of the first housing, the door including a photovoltaic panel, the photovoltaic panel being adapted to charge the at least one battery;

a first collection channel below the pulverizing device in the first compartment;

a second collection channel below the shredding device in the second compartment;

a first collection drawer in communication with the first collection channel; and a second collection drawer in communication with the second collection channel;

wherein the first collection channel is configured to gather and direct waste processed by the pulverizing device to the first collection drawer and the second collection channel is configured to gather and direct waste processed by the shredding device to the second collection drawer.

2. The compostable waste processing apparatus according to claim 1, wherein the first collection channel and the second collection channel each include an ejection device to direct processed waste to respective ones of the first and second collection drawers, the ejection device being selected from the group consisting of a fan, a blower, and a screw.

3. The compostable waste processing apparatus according to claim 1, wherein the first housing includes one or more walls having fiberglass insulation.

4. The compostable waste processing apparatus according to claim 1, wherein the pulverizing device includes two horizontally aligned rotary shafts, each of the shafts extending through a series of pulverizing elements, the pulverizing elements being configured to rotate around a respective one of the shafts for pulverizing waste disposed in the first compartment.

5. The compostable waste processing apparatus according to claim 1, wherein the shredding device includes two horizontally aligned rotary shafts, each of the shafts extending through a series of shredding elements, each of the shredding elements being configured to rotate around a respective one of the shafts for shredding waste disposed in the second compartment.

6. The compostable waste processing apparatus according to claim 1, wherein at least an exterior portion of the compostable waste processing apparatus includes a reflective insulating material.

7. The compostable waste processing apparatus according to claim 6, wherein the reflective insulating material includes a polyethylene bubbled film sandwiched between two aluminum sheets.

8. The compostable waste processing apparatus according claim 1, further comprising a ventilation motor in the second housing, the ventilation motor configured to circulate air throughout the first housing.

* * * * *